US010864531B2

(12) United States Patent
Zeeb

(10) Patent No.: US 10,864,531 B2
(45) Date of Patent: Dec. 15, 2020

(54) NOZZLE FOR SPRAYING LIQUIDS

(71) Applicant: Thomas Zeeb, Koengen (DE)

(72) Inventor: Thomas Zeeb, Koengen (DE)

(73) Assignee: LECHLER GMBH, Metzingen (DE)

( * ) Notice: Subject to any disclaimer, the term of this patent is extended or adjusted under 35 U.S.C. 154(b) by 0 days.

(21) Appl. No.: 15/598,701

(22) Filed: May 18, 2017

(65) Prior Publication Data

US 2017/0333921 A1 Nov. 23, 2017

(30) Foreign Application Priority Data

May 19, 2016 (DE) ..... 10 2016 208 653

(51) Int. Cl.

| | |
|---|---|
| ***B05B 1/14*** | (2006.01) |
| ***B05B 1/06*** | (2006.01) |
| ***B05B 7/04*** | (2006.01) |
| ***B05B 7/08*** | (2006.01) |
| ***B05B 1/02*** | (2006.01) |
| ***B05B 7/24*** | (2006.01) |

(52) U.S. Cl.

CPC ..... *B05B 1/14* (2013.01); *B05B 1/02* (2013.01); *B05B 1/06* (2013.01); *B05B 7/0466* (2013.01); *B05B 7/0892* (2013.01); *B05B 7/24* (2013.01)

(58) Field of Classification Search

CPC .... B05B 1/14; B05B 1/02; B05B 7/24; B05B 7/0892; B05B 7/0466; B05B 1/06

See application file for complete search history.

(56) References Cited

U.S. PATENT DOCUMENTS

| | | | | |
|---|---|---|---|---|
| 1,062,714 A | | 5/1913 | Johnston | |
| 3,140,826 A | | 7/1964 | Kudelka | |
| 3,913,845 A | | 10/1975 | Tsuji | |
| 4,828,181 A | | 5/1989 | Singels-Craenen | |
| 4,890,793 A | * | 1/1990 | Fuglistaller ..... | B05B 7/0458 239/290 |
| 5,143,297 A | | 9/1992 | De Michele et al. | |
| 5,368,230 A | * | 11/1994 | Oppenberg ..... | B05B 7/0416 239/132.5 |

(Continued)

FOREIGN PATENT DOCUMENTS

| | | |
|---|---|---|
| CN | 101360534 A | 2/2009 |
| CN | 102905795 A | 1/2013 |

(Continued)

OTHER PUBLICATIONS

Search Report of German Patent Office issued in Application No. 10 2016 208 653.7 dated Feb. 22, 2017 (5 pages).

(Continued)

*Primary Examiner* — Qingzhang Zhou

(74) *Attorney, Agent, or Firm* — Flynn Thiel, P.C.

(57) ABSTRACT

A nozzle for spraying liquids, in particular a dual-substance nozzle, having a nozzle housing and a plurality of outlet openings in the nozzle housing, wherein each outlet opening is arranged at the end of an outlet passage through the wall of the nozzle housing, and wherein the plurality of outlet openings is arranged in a circle on the nozzle housing. An outlet angle which the respective central axis of the outlet passage associated with the outlet opening encloses with a central longitudinal axis of the nozzle housing differs between at least one first and at least one second outlet opening.

4 Claims, 5 Drawing Sheets

(56) References Cited

U.S. PATENT DOCUMENTS

| | | | | |
|---|---|---|---|---|
| 5,553,783 | A | 9/1996 | Slavas et al. | |
| 5,829,683 | A * | 11/1998 | Beaudoin | B05B 7/0441 239/429 |
| 5,860,600 | A * | 1/1999 | Schindler | B05B 1/14 239/463 |
| 6,622,944 | B1 * | 9/2003 | Hurley | F23D 11/102 239/426 |
| 6,969,014 | B2 | 11/2005 | Bauer et al. | |
| 8,074,900 | B2 * | 12/2011 | Brown | B05B 7/0466 239/429 |
| 8,672,234 | B2 | 3/2014 | Amaya et al. | |
| 9,421,557 | B2 | 8/2016 | Dziadzio et al. | |
| 9,441,580 | B2 | 9/2016 | Amaya et al. | |
| 2004/0262429 | A1 | 12/2004 | Bauer et al. | |
| 2010/0014378 | A1 | 1/2010 | Strahmann | |
| 2011/0284652 | A1 | 11/2011 | Amaya et al. | |
| 2013/0021871 | A1 | 1/2013 | Strahmann | |
| 2014/0191055 | A1 | 7/2014 | Amaya et al. | |
| 2016/0245241 | A1 | 8/2016 | Amaya et al. | |

FOREIGN PATENT DOCUMENTS

| | | | |
|---|---|---|---|
| DE | 1226917 | B | 10/1966 |
| DE | 32 11 886 | A1 | 11/1982 |
| DE | 691 01 869 | T2 | 12/1994 |
| DE | 103 19 582 | A1 | 12/2004 |
| DE | 10 2005 060 841 | A1 | 7/2006 |
| EP | 0 268 702 | A1 | 6/1988 |
| EP | 1 325 782 | A2 | 7/2003 |
| FR | 2 212 497 | A1 | 7/1974 |
| WO | WO 2011/146274 | A1 | 11/2011 |
| WO | WO2011146274 | * | 11/2011 |

OTHER PUBLICATIONS

European Search Report of the European Patent Office issued in Application No. 17 17 0683 with English translation of category of cited documents dated Aug. 10, 2017 (9 pages).

Office Action of Chinese Patent Office issued in Chinese Application 201710358556.1 dated Nov. 1, 2018 (10 pages).

* cited by examiner

NOZZLE FOR SPRAYING LIQUIDS

CROSS-REFERENCE TO RELATED APPLICATIONS

This claims priority from German Application No. 10 2016 208 653.7, filed on May 19, 2016, the disclosure of which is hereby incorporated by reference in its entirety.

FIELD, BACKGROUND AND SUMMARY OF THE INVENTION

The invention relates to a nozzle for spraying liquids, having a nozzle housing and a plurality of outlet openings in the nozzle housing, wherein each outlet opening is arranged at the end of an outlet passage through the wall of the nozzle housing, and wherein the plurality of outlet openings is arranged in a circle along at least one imaginary circular line on the nozzle housing.

The invention is intended to improve a nozzle for spraying liquids in respect of distribution of the droplet sprays produced.

According to the invention, a nozzle having the features of claim 1 is provided for this purpose. A nozzle according to the invention for spraying liquids has a nozzle housing and a plurality of outlet openings in the nozzle housing, wherein each outlet opening is arranged at the end of an outlet passage through the wall of the nozzle housing. The plurality of outlet openings is arranged in at least one circle on the nozzle housing. An outlet angle which the respective central axis of the outlet passage associated with the outlet opening encloses with a central longitudinal axis of the nozzle housing differs between at least one first and at least one second outlet opening. Thus, the outlet openings do not all dispense a droplet spray at the same outlet angle but the outlet angle differs between different outlet openings. It is thereby possible to cover a larger area with a droplet spray than would be the case if the outlet angle of all the outlet openings were constant. By means of the nozzle according to the invention, it is possible to provide a larger number of outlet openings on the nozzle housing than would be the case if the outlet angle of all the outlet openings were constant. This is because each outlet opening dispenses a conical droplet spray. Through a skilful choice of the individual outlet angles, the individual conical droplet sprays can be arranged adjacent to one another in such a way that they cover as large as possible an area in a process chamber but overlap only slightly, if at all. Precisely in applications in the gas cooling sector, this allows greater coverage of the water injection plane, and shorter evaporation distances can be obtained with a droplet size and droplet distribution which are otherwise the same. More specifically, it is possible, by means of the invention, to employ outlet-opening and outlet-passage geometries which produce a relatively small opening angle of the conical droplet spray emerging. Compared with the prior art, it is then possible with the invention to arrange a larger number of such outlet openings with varying outlet angles, thus ensuring that greater coverage is achieved with all the droplet sprays produced than with a conventional nozzle that has constant outlet angles for all the outlet openings. Outlet openings which produce a small opening angle of the droplet spray produced can produce a droplet spray with a droplet size distribution that fluctuates less than with outlet openings that produce a larger opening angle of the droplet spray produced. It is thereby possible to achieve advantages specifically in applications in the gas cooling sector. It is advantageous if two different outlet angles relative to the central longitudinal axis of the nozzle housing are chosen for the plurality of outlet openings although, within the scope of the invention, it is also possible to use more than two different outlet angles of the outlet openings.

As a development of the invention, a plurality of first outlet openings is arranged in a circle along an imaginary first circular line having a first radius, and a plurality of second outlet openings is arranged in a circle along an imaginary second circular line having a second radius, which is different from the first radius, wherein the first and the second circular lines are concentric with respect to one another.

In this way, it is possible to achieve an annular impingement area over a planar area arranged perpendicularly to the central longitudinal axis of the nozzle housing. As explained, the individual conical droplet sprays which emerge from the outlet openings are arranged in such a way here that they overlap each other only slightly, if at all. Within the scope of the invention, however, it is also perfectly possible for the outlet openings to be provided on more than two concentric circular lines, each with different outlet angles.

As a development of the invention, the mouth openings of the outlet passages on the inside of the wall of the nozzle housing are situated on a common imaginary circular line.

In this way, it is possible to achieve substantially identical conditions for all outlet passages in the discharge region into the outlet passages in the interior of the nozzle housing, thus making it possible to ensure that the droplet size and distribution of all the droplet sprays discharged through the outlet openings are substantially the same.

As an alternative to the arrangement described above, the mouth openings of the outlet passages on the inside of the wall of the nozzle housing can be situated on two mutually concentric imaginary circular lines, and the outlet openings can be situated on a common imaginary line.

As a development of the invention, the nozzle is designed as a dual-substance nozzle having an internal mixing chamber, wherein the mixing chamber has a liquid inlet and a gas inlet.

Dual-substance nozzles are advantageous precisely for applications in the gas cooling sector. By means of the invention, conventional dual-substance nozzles can be improved in respect of the distribution of the droplet spray produced.

As a development of the invention, the mixing chamber is of annular design, wherein the outlet passages start from the mixing chamber.

As a development of the invention, a conical distribution wall is provided, wherein the annular mixing chamber adjoins the distribution wall at the side or adjoins a circumferential edge of the distribution wall.

A conical distribution wall is used to distribute an introduced liquid jet into a uniform thin film, which is then divided into individual droplets at the entry of the mixing chamber by the gas jets, which are likewise entering the mixing chamber.

As a development of the invention, an imaginary extension of at least one gas inlet passage extends into the region of the circumferential edge of the conical distribution wall.

In this way, the gas jets from the gas inlet passage or from a plurality of gas inlet passages impinge on the water film produced by means of the distribution wall precisely where this film leaves the distribution wall. This promotes the breakup of the water film into individual droplets.

BRIEF DESCRIPTION OF THE DRAWINGS

Further features and advantages of the invention will become apparent from the claims and the following description of a preferred embodiment of the invention in conjunction with the drawings, in which:

DETAILED DESCRIPTION

Figure 1:
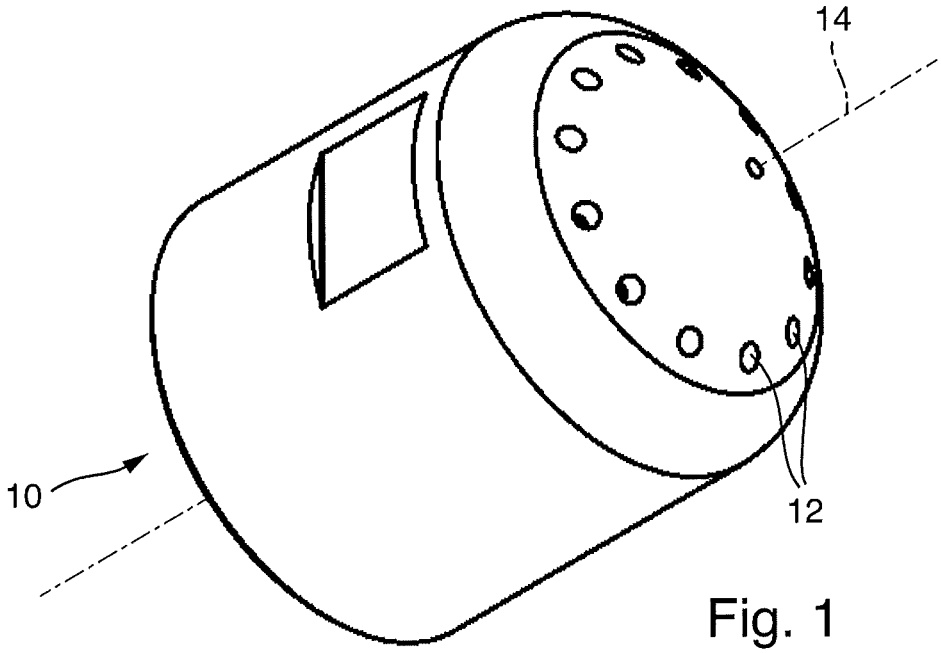
FIG. 1 shows a nozzle housing of a dual-substance nozzle according to the prior art.

The illustration in FIG. 1 shows a nozzle housing 10 of a dual-substance nozzle according to the prior art. The nozzle housing 10 has a plurality of outlet openings 12, which are arranged along an imaginary circular line around a central longitudinal axis 14 of the nozzle housing. With the central longitudinal axis 14, outlet passages that are arranged in the wall of the nozzle housing 10 and that lead to the outlet openings 12 enclose a constant outlet angle, which is the same for all the outlet passages associated with the outlet openings 12.

Figure 2:
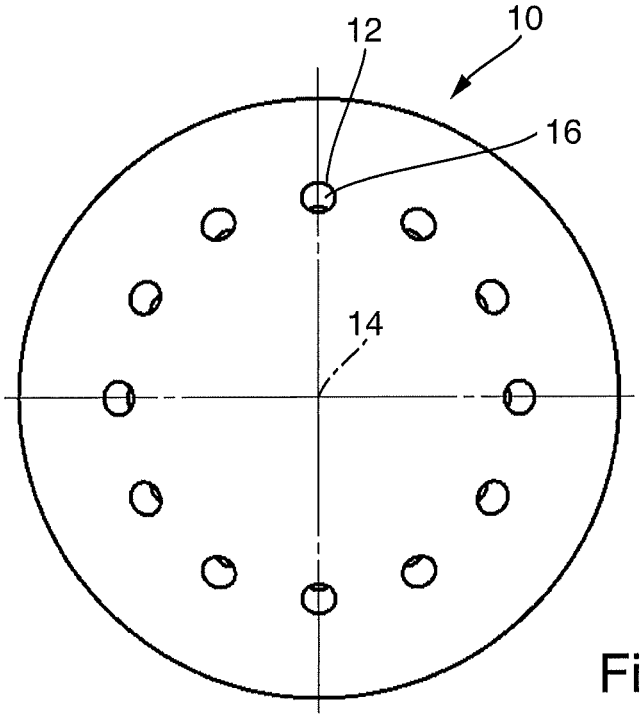
FIG. 2 shows a front view of the nozzle housing in FIG. 1.

The illustration in FIG. 2 shows the nozzle housing 10 from the front. The outlet openings 12, which are arranged on an imaginary circular line around the central longitudinal axis 14, can be seen. Twelve outlet openings 12 are provided in total. Outlet passages 16, which end at the respective outlet openings 12, can be seen in part in FIG. 2. The illustration in FIG. 2 furthermore shows that the outlet passages 16 are all arranged at the same outlet angle, wherein a respective central axis of the outlet passages 16 and the central longitudinal axis 14 of the nozzle housing enclose the outlet angle.

Figure 3:
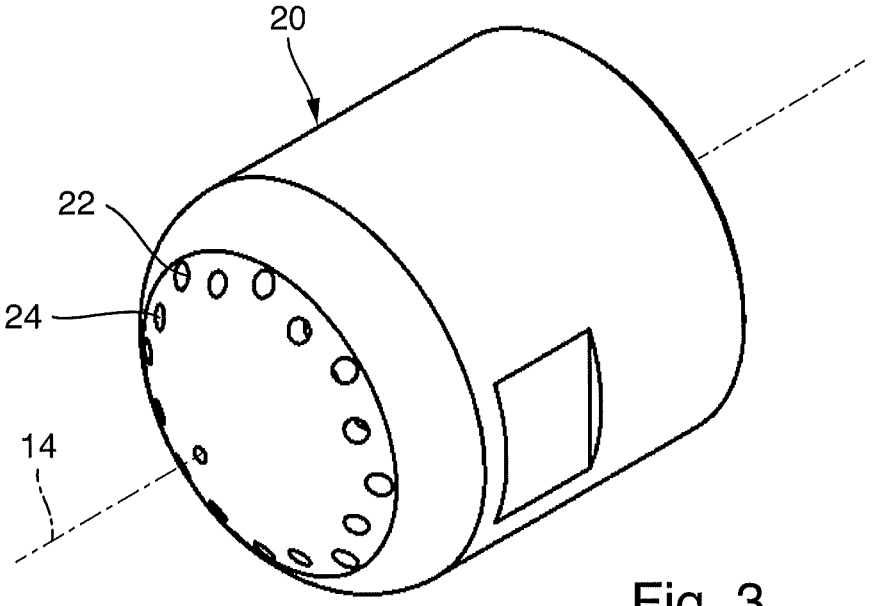
FIG. 3 shows a view of a nozzle housing of a dual-substance nozzle according to the invention obliquely from above.

The illustration in FIG. 3 shows a nozzle housing 20 of a dual-substance nozzle according to the invention. The nozzle housing 20 is provided with a plurality of first outlet openings 22 and a plurality of second outlet openings 24. The first outlet openings 22 differ from the second outlet openings 24 in the arrangement thereof on a front side of the nozzle housing 20 and, as will be explained, in an outlet angle which the respective central axis of the outlet passage associated with the outlet openings 22, 24 encloses with the central longitudinal axis 14 of the nozzle housing 20.

Figure 4:
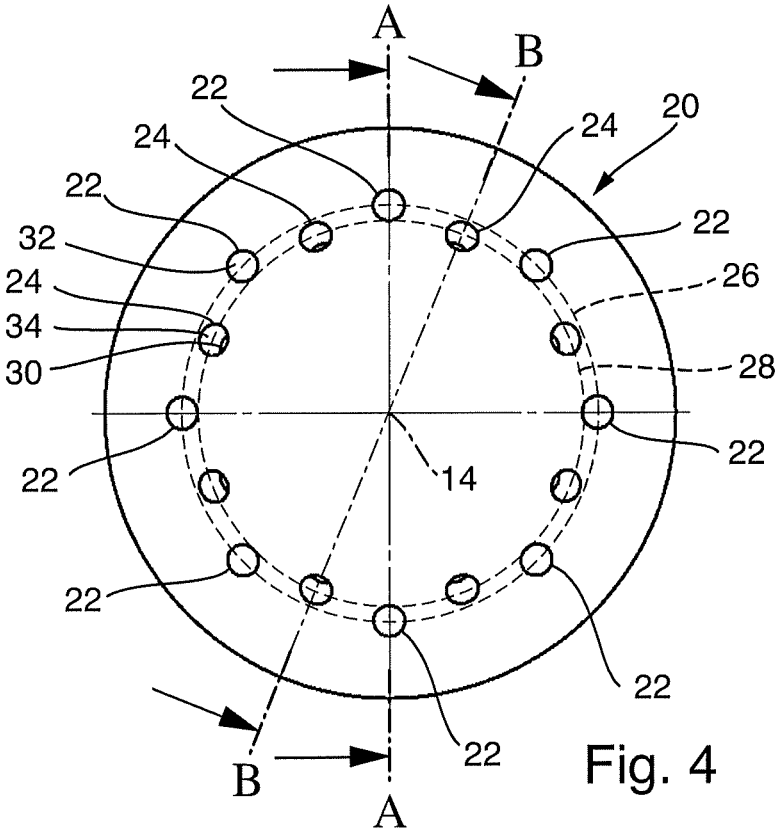
FIG. 4 shows a view of the nozzle housing in FIG. 3 from the front.

The illustration in FIG. 4 shows a front view of the nozzle housing 20. It can be seen that all the first outlet openings 22 are arranged in such a way that the centres thereof are situated on a first imaginary circular line 26. The second outlet openings 24, in contrast, are arranged in such a way that the centres thereof are situated on a second imaginary circular line 28 on the front side of the nozzle housing 20. A radius measured from the central longitudinal axis 14 of the nozzle housing 20 is longer in the case of the first circular line 26 than the second circular line 28.

In the front view in FIG. 4, it can already be seen that an outlet angle which the central axes of the outlet passages associated with the first outlet openings 22 enclose with the central longitudinal axis 14 of the nozzle housing 20 differs from the corresponding outlet angle of the second outlet openings 24. More specifically, the outlet angles of the first outlet openings 22 are larger than the outlet angles of the second outlet openings 24. In FIG. 4, this can be seen from the fact that a section of the mouth openings 30 of the respective outlet passages 34 can be seen at the outlet openings 24. At the outlet openings 22, the corresponding mouth openings of the associated outlet passages 32 cannot be seen.

Figure 5:
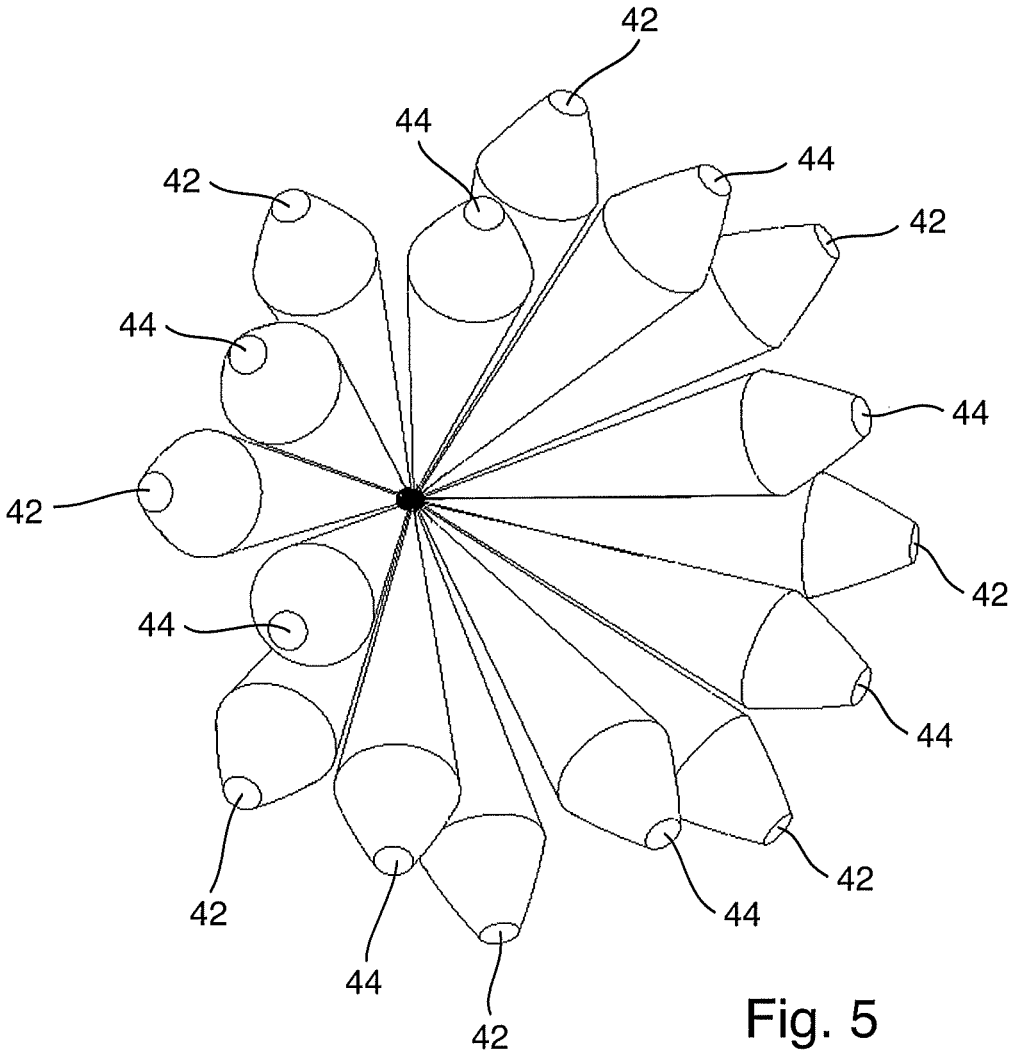
FIG. 5 shows a schematic illustration of the distribution of the individual conical droplet sprays which emerge from the outlet openings of the nozzle housing in FIG. 3.

The illustration in FIG. 5 shows schematically droplet sprays 42 and 44 emerging from the outlet openings 22 and 24, respectively. It can be seen that the droplet sprays 42, 44 are each of conical configuration and that the droplet sprays 42, 44 are arranged in such a way that they do not touch each other. It is thereby possible to avoid the individual droplet sprays 42, 44 being influenced. At the same time, the droplet sprays 42, 44 are arranged in such a way that the surface lines thereof run approximately parallel in the region in which there is the smallest distance between two droplet sprays 42, 44. As a result, as large as possible an annular region on an impingement surface can be acted upon continuously by means of the droplet sprays 42, 44 and, at the same time, mutual influencing of the individual droplet sprays 42, 44 is largely avoided. From FIGS. 4 and 5 it can be seen that a total of eight first outlet openings 22 is provided, which then produce eight conical droplet sprays 42. In the same way, eight second outlet openings 24 are provided, which produce eight conical droplet sprays 44.

Compared with the conventional dual-substance nozzle 10 in FIGS. 1 and 2, more outlet openings are therefore used, wherein the first and second outlet openings 22, 24 and the associated outlet passages 32, 34 are dimensioned in such a way that the conventional dual-substance nozzle having the nozzle housing 10 in FIGS. 1 and 2 and the dual-substance nozzle according to the invention having the nozzle housing 20 in FIGS. 3 and 4 output the same quantity of liquid with the same ratio of air or gas to liquid. As a result, the cone angles of the individual droplet sprays 42, 44 can be reduced relative to the cone angles of the droplet sprays emerging from the outlet openings 12 of the conventional dual-substance nozzle. It is thereby possible to achieve more uniform distribution of the droplet diameters in the individual droplet sprays 42, 44. As a result, the dual-substance nozzle according to the invention having the nozzle housing 20 offers considerable advantages in the case of applications in the gas cooling sector since it can provide greater coverage of the injection plane with liquid, in particular water and can also achieve shorter evaporation distances.

Figure 6:
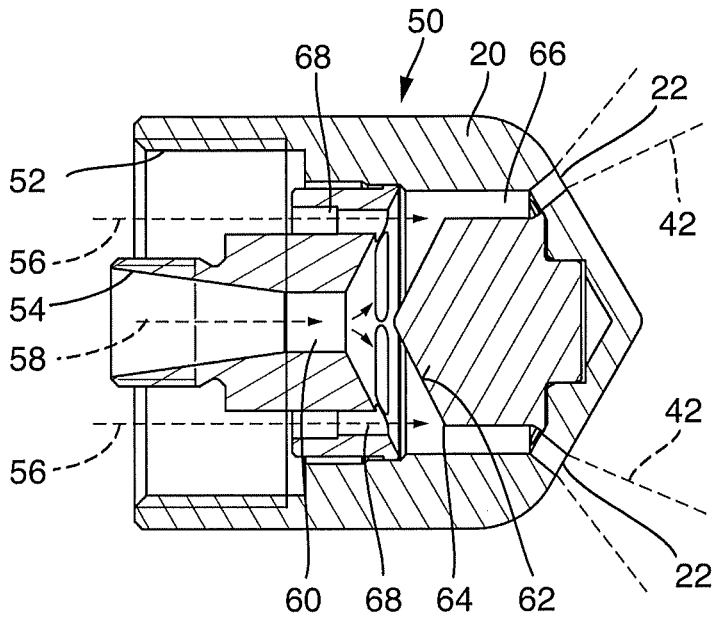
FIG. 6 shows a sectioned view of a dual-substance nozzle according to the invention having the nozzle housing in FIG. 3, wherein the section plane runs along the line A-A in FIG. 4.

The illustration in FIG. 6 shows a dual-substance nozzle 50 according to the invention which is provided with the nozzle housing 20 that has already been shown in FIG. 3 and FIG. 4. FIG. 6 shows a sectioned view, wherein the section plane A-A has already been shown in FIG. 4 and wherein this section plane passes through two first outlet openings 22.

The dual-substance nozzle 50 has an air inlet 52 and a water inlet 54, wherein the air inlet 52 and the water inlet are arranged concentrically with one another and wherein the water inlet 54 is arranged within the annular air inlet 52. Air entering the nozzle housing 20 is indicated by means of dashed arrows 56, and water entering the nozzle housing 20 is indicated by means of a dashed arrow 58.

Water enters through the water inlet 54, which first of all narrows in a frustoconical shape. After a section 60 of constant diameter, the water inlet passage once again widens in a conical shape. The entering waterjet then impinges upon a conical distribution wall 62, the cone tip of which lies on the central longitudinal axis of the nozzle housing 20. As illustrated by means of two small curved arrows which extend arrow 58, the entering liquid jet is divided and is split by means of the distribution wall 62 into a film which moves further out in an approximately radial direction on the conical distribution wall 62. The conical distribution wall 62 ends at an encircling circumferential edge 64. At the circumferential edge 64, the distribution wall merges into an annular mixing chamber 66.

Starting from the air inlet 52, passages 68 lead in a straight line to the mixing chamber 66. In accordance with the arrow 56, the entering air jets thus impinge in the region of the circumferential edge 64 upon the liquid film that is just leaving the distribution wall 62 at the circumferential edge 64. The liquid film is thereby broken down into individual droplets by means of the air jets. The droplet/air mixture then moves through the annular mixing chamber 66 and continues to be intimately mixed, with the result that a droplet spray can then emerge at the outlet openings 22, 24. As already explained with reference to FIG. 5, a conical droplet spray 42 emerges at each of the outlet openings 22. The second outlet openings 24 are not visible in the sectioned view in FIG. 6.

Figure 7:
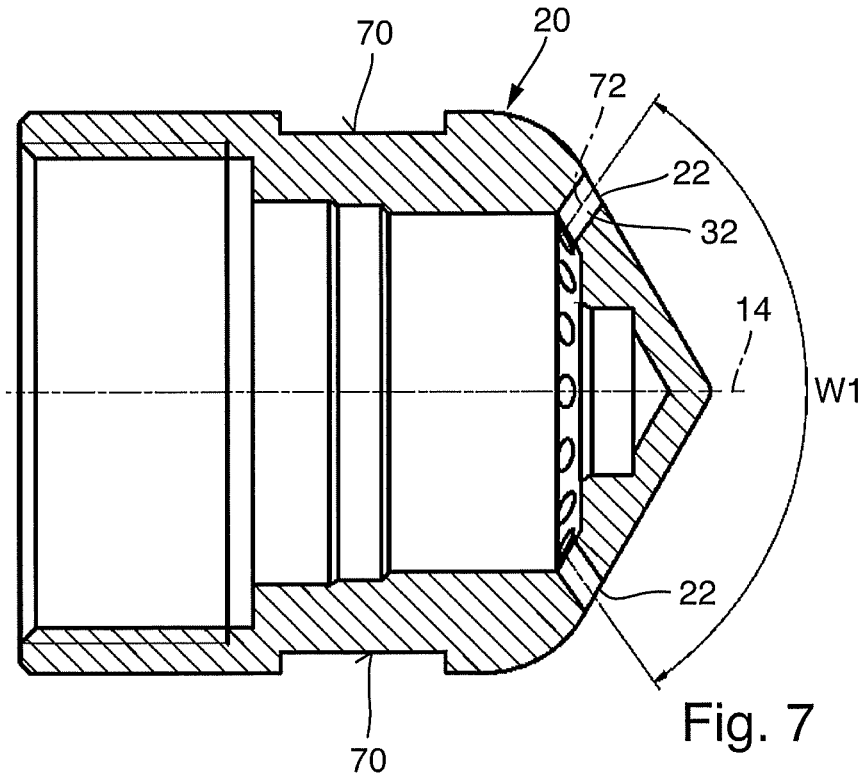
FIG. 7 shows a view of section plane A-A in FIG. 4.

The illustration in FIG. 7 shows an enlarged sectioned view of the nozzle housing 20, wherein the section plane passes through flat tool engagement surfaces 17 on the outside of the nozzle housing 20, see FIG. 3. FIG. 7 shows the double outlet angle W1 which lies between the central axes 72 of the outlet passages 32 of two outlet openings 22 situated in the section plane. In the context of the present description, however, an angle which the central axes 72 of the outlet passages 32 enclosed with the central longitudinal axis 14 of the nozzle housing 20 is referred to as the outlet angle. This outlet angle is thus W1/2. In the embodiment shown, the outlet angle of the first outlet openings, i.e. the angle W1/2, which the central axes 72 of the outlet passages 32 enclose with the central longitudinal axis 14 of the nozzle housing 20, is about 55°. Thus, the angle W1 is about 110° in FIG. 7.

Figure 8:
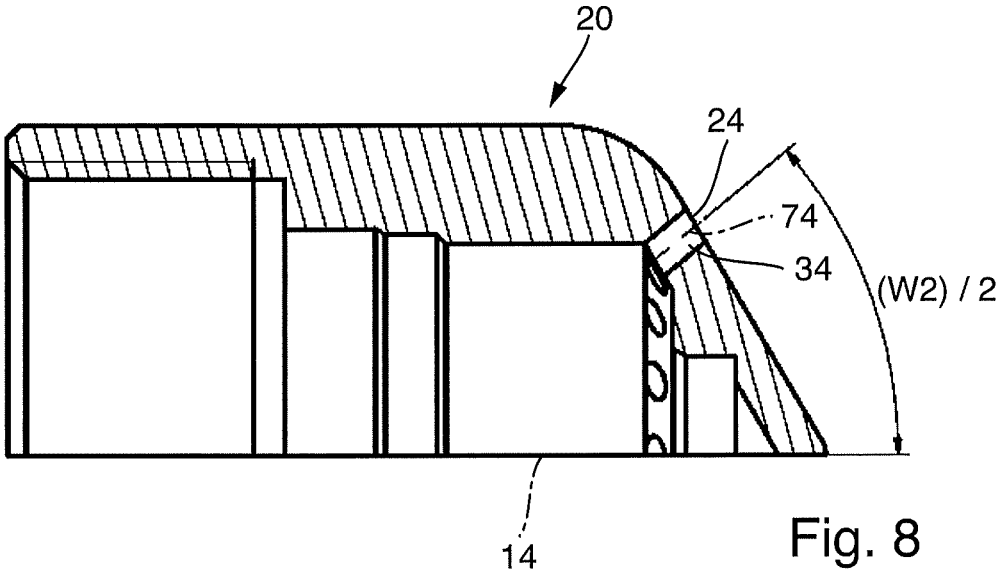
FIG. 8 shows a partial view of section plane B-B in FIG. 4.

FIG. 8 shows a partial sectioned view of plane B-B in FIG. 4. Section plane B-B passes through two second outlet openings 24, wherein the sectioned view is shown only as far as the central longitudinal axis 14 of the nozzle housing 20 in FIG. 8. An outlet passage 34 is associated with each of the outlet openings 24. An angle which the central axis 74 of the outlet passages 34 encloses with the central longitudinal axis 14 of the nozzle housing 20 is denoted by W2/2 in FIG. 8. This outlet angle is about 40° in the embodiment illustrated.

Figure 9:
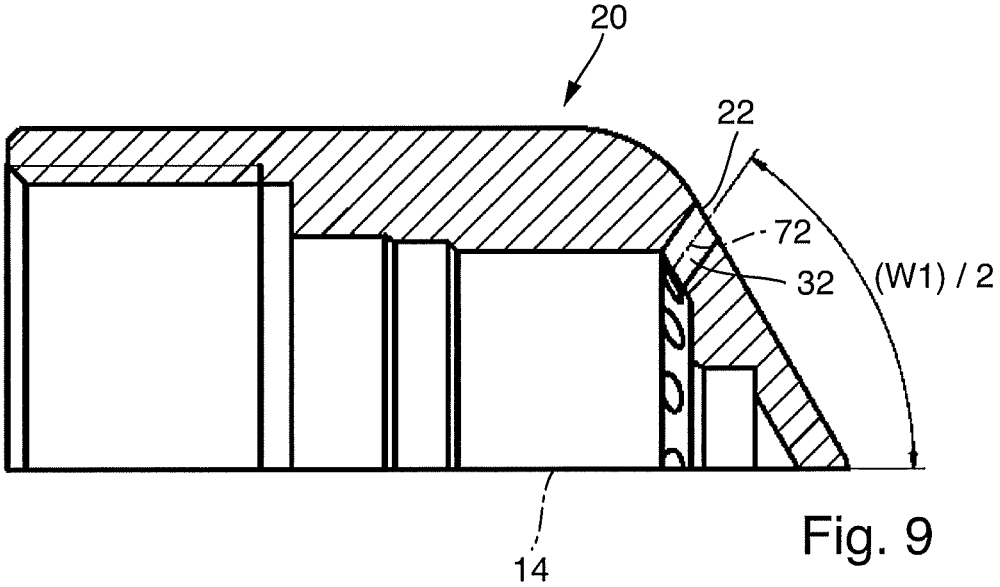
FIG. 9 shows a partial view of section plane A-A in FIG. 4.

FIG. 9 shows a partial view of section plane A-A in FIG. 4, wherein the section plane passes through two first outlet openings 22. However, the section plane is shown only as far as the central longitudinal axis 14 of the nozzle housing 20. As has already been explained with reference to FIG. 7, the central axes 72 of the outlet passages 32 associated with the first outlet openings 22 assume an outlet angle W1/2 with the central longitudinal axis 14 of the housing 20, said angle being about 55° in the embodiment illustrated. The outlet angle W1/2 associated with the first outlet openings 22 is thus larger than the outlet angle W2/2 associated with the second outlet openings 24. The effects of these different outlet angles can be seen in the schematic illustration in FIG. 5.

It can also be seen in FIGS. 7, 8 and 9 that the mouth openings of all the outlet passages 32, 34 are situated on a common imaginary circular line on the inside of the wall of the nozzle housing 20. As a result, identical conditions pertain in the region of the mouth openings of the outlet passages 32, 34 by virtue of the rotationally symmetrical construction of the dual-substance nozzle 50, see FIG. 6, and therefore the droplet size and droplet distribution within the droplet sprays 42, 44, see FIG. 5, is substantially the same.

The invention claimed is:

1. A nozzle for spraying liquids comprising a nozzle housing and a plurality of outlet openings in the nozzle housing, wherein each outlet opening of the plurality of outlet openings is arranged at an end of one of a plurality of outlet passages through a wall of the nozzle housing, and wherein the plurality of outlet openings are arranged in a circle along at least one imaginary circular line on the nozzle housing, wherein an outlet angle which a respective central axis of one of the plurality of outlet passages associated with one of the plurality of outlet openings encloses with a central longitudinal axis of the nozzle housing differs between at least one first outlet opening, at least one second outlet opening and at least one third outlet opening of the plurality of outlet openings, wherein the nozzle is designed as a dual-substance nozzle having an internal mixing chamber, and wherein the internal mixing chamber has a liquid inlet and a gas inlet, wherein the internal mixing chamber is of annular design, wherein the plurality of outlet passages start from the internal mixing chamber, wherein a conical distribution wall is provided, wherein the internal mixing chamber adjoins a circumferential edge of the conical distribution wall, and wherein mouth inlets of the plurality of outlet passages on an inside of the wall of the nozzle housing are situated on a common imaginary circular line, and wherein in a sectional view onto a sectional plane containing the central longitudinal axis, an outer wall of the internal mixing chamber forms a pair of straight lines and a peripheral wall of at least one of the plurality of outlet passages continues from an end of the outer wall of the internal mixing chamber and diverges away from the central longitudinal axis.

2. The nozzle according to claim 1, wherein the at least one first outlet opening is a plurality of first outlet openings, the at least one second outlet opening is a plurality of second outlet openings, the at least one third outlet opening is a plurality of third outlet openings, the plurality of first outlet openings is arranged in a circle along an imaginary first circular line having a first radius, the plurality of second outlet openings is arranged in a circle along an imaginary second circular line having a second radius, which is different from the first radius, and the plurality of third outlet openings is arranged along an imaginary third circular line having a third radius, wherein the first, the second and the third circular lines are concentric with respect to one another.

3. The nozzle according to claim 1, wherein an imaginary extension of at least one gas inlet passage extends into a region of the circumferential edge of the conical distribution wall.

4. The nozzle according to claim 1, wherein the internal mixing chamber of annular design is located between the mouth inlets and the conical distribution wall.

* * * * *